US005640138A

United States Patent [19]

Hinkley et al.

[11] Patent Number: 5,640,138

[45] Date of Patent: Jun. 17, 1997

[54] GOLF COURSE ELECTRONIC SAFETY DEVICE

[75] Inventors: Michael E. Hinkley, Middlesex, Mass.; Richard M. Mara, Shapleigh, Me.; Gerald F. Ross, Sarasota, Fla.

[73] Assignee: Anro Engineering, Inc., Maynard, Mass.

[21] Appl. No.: 524,615

[22] Filed: Sep. 7, 1995

[51] Int. Cl.[6] ..... G08B 23/00

[52] U.S. Cl. ..... 340/323 R; 340/539; 340/825.36; 340/825.37; 340/332; 473/168; 473/173; 473/404

[58] Field of Search ..... 340/323 R, 539, 340/573, 309.15, 825.36, 825.37, 825.72, 332, 321, 322; 473/173, 168, 404, 169, 266, 172; 273/183.1

[56] References Cited

U.S. PATENT DOCUMENTS 4,003,043 1/1977 Little et al. ..... 340/403
4,206,445 6/1980 Steinhauer ..... 340/321
4,483,683 11/1984 Alley, Sr. ..... 441/69
5,400,008 3/1995 Toohey ..... 340/321

*Primary Examiner*—Jeffery Hofsass
*Assistant Examiner*—Julie B. Lieu
*Attorney, Agent, or Firm*—George Grayson

[57] ABSTRACT

A safety device is used to protect golfers located in blind areas of a golf course from balls being driven, for example, off the tee. The safety device is manually activated by a push-button switch once the golfers enter the blind area. The switch initiates a low current drain, high-intensity, strobe light blinking at a 1 Hz rate that is visible from both the tee and blind areas even in bright sunshine. An electronic timer deactivates the strobe after N minutes. A wireless transmitter link located outside the blind area can be used to recycle the timer prior to the elapsed time (minutes) for those golfers who play more quickly.

8 Claims, 5 Drawing Sheets

Legend:

Normally Open Relay Contact

Normally Closed Relay Contact

GOLF COURSE ELECTRONIC SAFETY DEVICE

BACKGROUND—FIELD OF INVENTION

This invention relates to the field of electronic devices used to protect golfers located in blind areas on a golf course from being seriously injured by driven balls.

BACKGROUND—DESCRIPTION OF PRIOR ART

There is a need to provide a low-cost and reliable means to protect golfers who enter blind areas on the golf course from being, inadvertently, hit by driven balls. For example, on some courses the tee and the green on either par 3 or short par 4 holes are not visible; golfers with a long drive on these holes can often reach the green. To guard against possible serious injury, some courses have installed cow bells or wind-up mechanical devices to warn people on the tee. Cow bells give some means of notification when golfers have already reached the tee. Residents of homes located close to the cow bell can be inconvenienced by the noise of the bell and have just cause to protest the noise to town or city officials. And there is no accurate means for the golfer about to tee off to judge how long to wait, safely, before swinging.

Some mechanical or electro-mechanical devices have also been devised to protect golfers. These devices include some type of flagging mechanism which is initiated by a golfer entering the blind area. For example, one such device involves pulling up and ratcheting a highly visible orange cylinder which, after N minutes, is pulled down by a high-field magnet and/or gravity. For this warning device, the cylinder must be buried 3–4 feet into the ground and is difficult to erect by some golfers because it requires a strong upward directed force. The current drain for such a solenoid and timing circuit tends to be high, requiring frequent battery replacement; for example, where electric power is not readily available, these batteries need to be replaced several times each week.

It should be noted that electric power is rarely continuously available on the golf course except, possibly, from the sprinkler head distribution system. Generally, four or more sprinkler heads are connected in series and are activated, simultaneously, by a computer-controlled switching program. Therefore, to obtain primary power for the safety sensor (e.g., 24 volts ac) it is necessary to program the computer to continuously activate a given zone, and employ a separate timer/water valve locally to activate the four heads. Although this is a far less costly method than bringing in a separate electrical power line from a distance, it is not a preferred solution because of the need for asynchronous timer control and a new housing in the zone. In addition, sufficient primary power to operate the safety sensor, the sprinkling head, and the timer may not be available from the controller.

OBJECTS AND ADVANTAGES

Accordingly, the prime object of the subject invention is to provide a cost-effective golf course warning device to avoid physical injury to players who are located in blind areas. It is another object and advantage of the invention to have a higher visibility even in bright sun conditions and to provide safer operation than other known devices without disturbing abutters.

Other objects of the invention are: to protect the slowest players while providing time efficiently to expert players, causing minimum course delay by employing "feedback" techniques; to provide for increased playing efficiency and simultaneously very low power drain, for example up to 60 days without the need for recharging; to maintain efficient operation under all weather conditions by incorporating UL approved waterproof containers, switches, and junctions; to make the operation of the system simple and efficient, requiring a player only to push a button to initiate the warning device by the closure of an electrical contact; to be easily installed, requiring non-expert labor and to use parts which are readily available from US suppliers.

Still further objects and advantages will become apparent from a consideration of the ensuing description and accompanying drawings.

SUMMARY

Figure 1A:
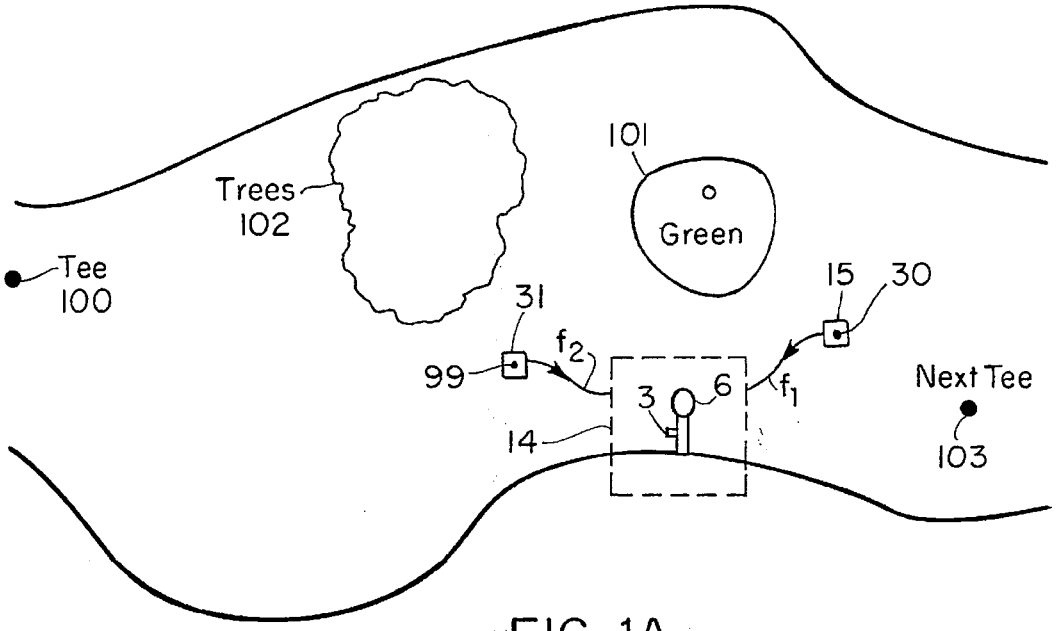
FIG. 1*a* Typical Topology for Installation of Golf Course Safety Sensor of a Dogleg Hole FIG. 1*b* Typical Topology for Installation of Golf Course Safety Sensor of a Green Hidden by a Hill FIG. 2 Basic Switching Logic for Golf Course Safety Sensor FIG. 3 The Schematic Location of a Remote Sensor Initiating Switch FIG. 4 The Schematic Drawing of the Electronic N Minute Timer and Its Location in the Sensor Circuit FIG. 5 The Golf Course Sensor Mechanical Assembly Drawing

The objects and advantages of the subject invention are achieved in the preferred embodiment described herein. According to the preferred embodiment of the invention, a high-intensity, low current drain, strobe light similar to what is used in a fire alert sensor is used as the warning indicator. Typically, the strobe light is mounted on a pole 6–8 feet above the ground. The high-intensity strobe flashes at about a one Hertz (Hz) rate. The strobe is activated by a golfer just entering a blind area by pushing a waterproof press-to-start button located at a standard height above the surface, typically 42". In addition to the button activating the high-intensity strobe light, an electronic timer is initiated. The timer initiates an electrical gate which recycles after N minutes. N, for example, may be set for 6–7 minutes. This time is set to accommodate the slowest likely foursome of golfers. At a convenient point, for example between the green being protected and the tee to the next hole, a separate transmitter is placed with a second push-to-stop button. When the golfers leave the protected green, one of them pushes this second button which, via a wireless link, radiates a signal to the strobe unit and other electronic circuitry recycling the timer. For average players, this switch may reduce the time of the on-time of the strobe from 7 to 4.5 minutes. This "feedback" signal then ensures player safety while conserving playing time; no wires need be used to affect the transmission of the feedback signal. This low current drain transceiver link has a range of about 150 yards. It is equipped with a conventional 9-volt battery that can last months.

The wireless transmitter unit is also mounted in a waterproof box with components designed to operate in the environment. A monopole or whip antenna is used to transmit the UHF signal. This 9-volt battery supply is used to excite a UHF oscillator in the box on the satellite pole producing a burst of energy. This transient coded signal is received by a low current drain UHF tuned receiver located in the primary unit where the signal is decoded and used to momentarily close a relay contact which recycles the timer and stops the strobe from pulsating.

The rechargeable batteries in the main unit are located to provide easy access for service and/or replacement. The electronic timer circuitry is also placed in the vicinity of the batteries. The strobe, which has a measured lifetime in excess of 1000 hours (of continuous operation), is mounted so it, too, can be conveniently changed in the event of burnout. An alternate method of charging the batteries can be accomplished by using solar panels.

PREFERRED EMBODIMENT AND DESCRIPTION OF OPERATION

A good warning system includes the ability to:

1. Provide high visibility and safe warning even in bright sun conditions to both the golfers on the green and the tee or other blind areas.
2. Provide the warning function over a sufficient period of time to protect even the slowest players. The trade-off here is safety versus incurring a time-delay for other players.
3. Avoid the need for installing primary power by using batteries and provide safety with very low power drain for increased battery lifetime. Rechargeable batteries should, generally, be used to keep operating costs low and should be readily accessible for recharging. Solar panels can be used to avoid maintenance of the batteries.
4. Maintain efficient and reliable operation in all possible outdoor weather conditions. All electronic components should be mounted in waterproof containers.
5. Be easily and obviously operated by all players.
6. Be easily installed. In some cases, for example, it is not practical to dig a 3–4 foot hole into the ground due to the existence of ledge.

Figure 1B:
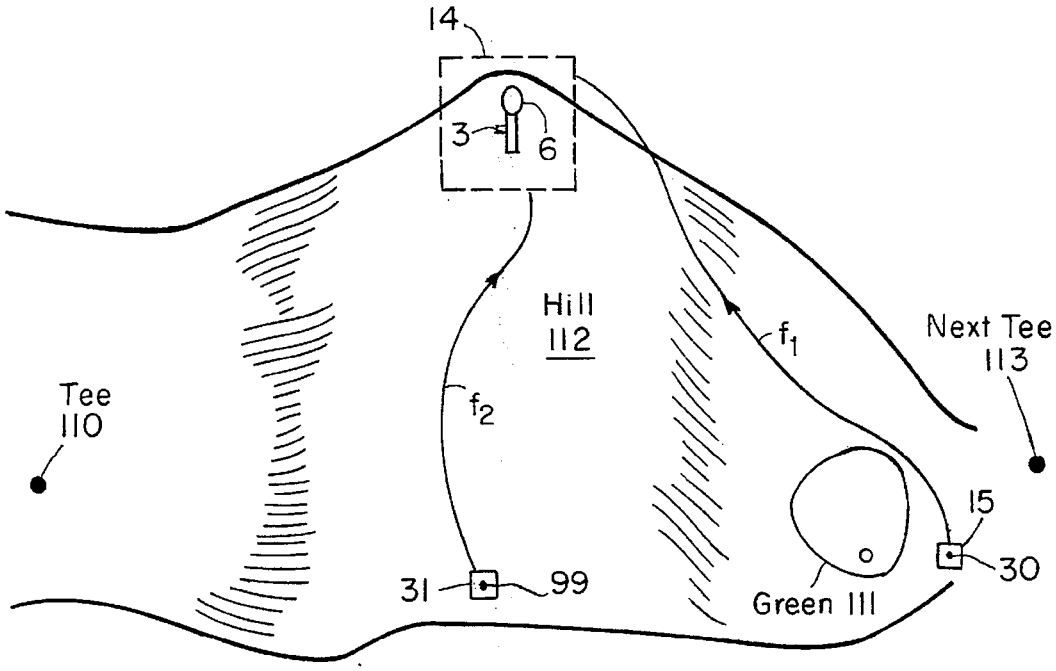

FIGS. 1*a* and 1*b* show typical topologies of some holes on a golf course. In both cases golfers standing at a tee cannot see golfers on the green waiting to hole out. Also, in both figures the hole is within the range of a driver; most golf courses have some blind areas.

FIG. 1*a* shows a dogleg hole having a tee area 100, a green area 101 and a group of trees and bushes 102 preventing a golfer standing at the tee 100 from seeing the green 101 since the trees and bushes 102 interfere with the line of sight. Golfers at the tee 100 are alerted by a flashing strobe light 6 mounted on a safety sensor 14, that golfers that have previously teed off are on the green 101. The sensor 14 is located in a position so that strobe light 6 can be seen from both the tee 100 and the green 101. Golfers at tee 100 know that they may tee off when strobe light 6 stops flashing. Presumably the previous golfers have moved to a next tee 103 and are out of harms way.

FIG. 1*b* shows a tee area 110, a hill 112 and a green area 111. The hill 112 prevents golfers at tee 110 from seeing golfers on the green 111. Here again, the strobe light 6 installed at the top of the hill 112 alerts the golfers at the tee 110 when the green 111 is clear. Presumably the previous golfers have moved to a next tee 113 and are out of harms way. Here again the golfers who have just teed off will depress switch 3 on sensor 14 which is located at the top of the hill to activate strobe light 6.

In both FIGS. 1*a* and 1*b* the golfers on the green should reset the strobe light 6 by depressing a switch 30 on a transceiver 15 which transmits a frequency $f_1$ if they have holed out before the strobe light 6 has timed out. A transmitter 31 which transmits a frequency $f_2$ may be located on the other side of the fairway to activate the strobe 6 if it is more convenient for the golfers to activate switch 99.

Figure 2:
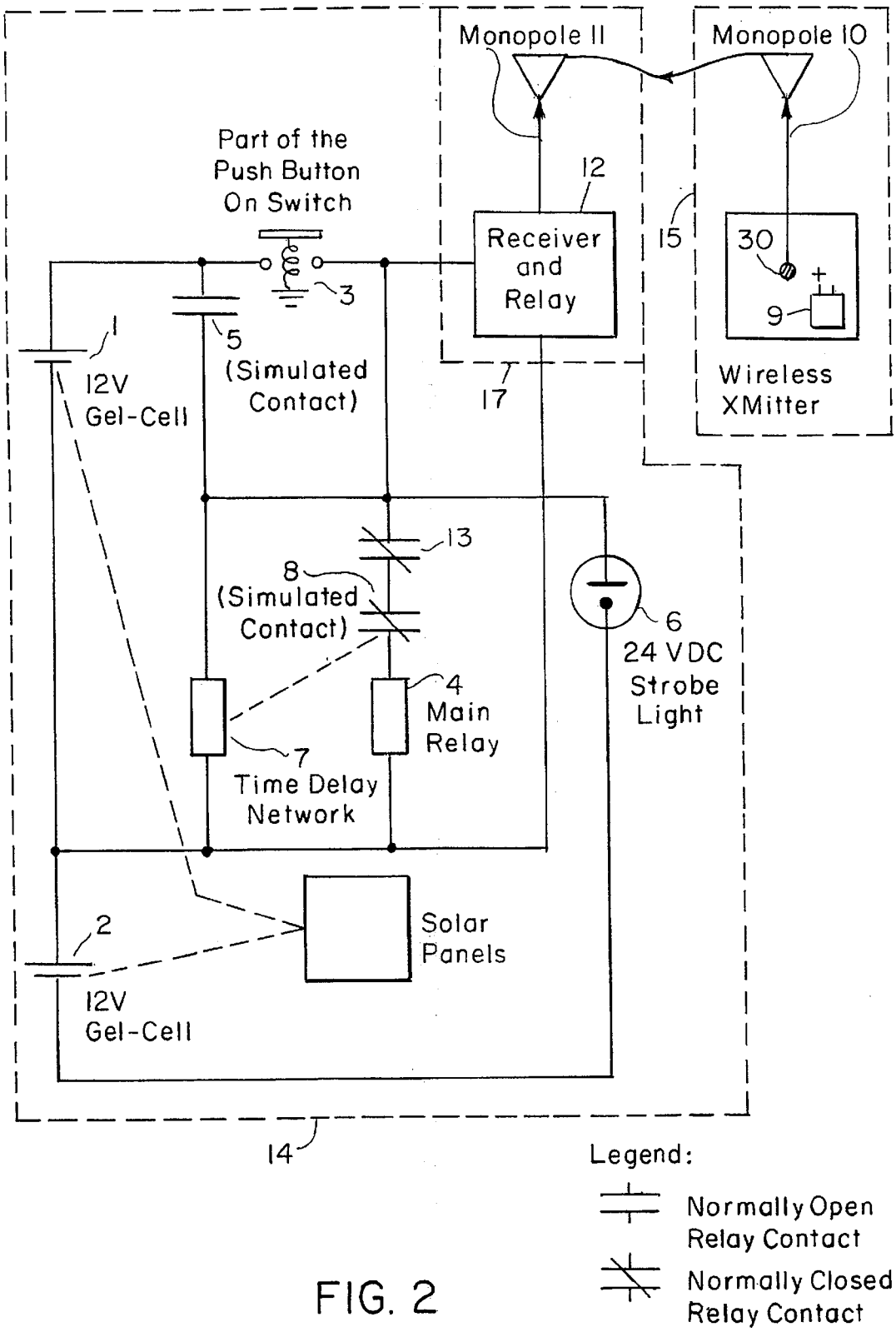

1. General. FIG. 2 shows a functional block diagram of a safety sensor 14. Two 12-volt rechargeable gel-cells 1 and 2 are used to power the sensor 14. Before a push-button switch 3 is closed, the sensor 14 is inert; no power is delivered to the circuit. When a golfer momentarily depresses a switch 3 (normally open), a relay 4 is activated, closing a holding contact 5. When spring-loaded switch 3 opens, the relay 4 continues to be energized by the current flowing from gel-cell 1 through holding contact 5. At the same time, 12 volts from gel-cell 1 is applied to a time-delay circuit 7, beginning the N minute countdown. The full voltage from gel-cells 1 and 2, 24 volts dc, is applied to strobe light 6 through contact 5, causing it to flash at typically a 1 Hz rate.

When the elapsed time of N minutes occurs, the circuitry within the timer network 7 energizes an internal relay which causes a normally closed contact 8 to open. This opening contact stops the current flowing through relay 4. This, in turn, opens holding contact 5, which both removes the power to time-delay circuit 7 and stops the strobe 6 from flashing. Relay contact 8 which initiated this sequential chain of events now returns to its normally closed state. But relay 4 does not reenergize, because switch 3 and contact 5 are now in their normally open states. Note that to aid in the explanation of the logic, contacts 5 and 8 are simulated in FIG. 2; the actual switch closures are accomplished with the aid of electronic circuitry, as described below.

Another mode by which relay 4 can be opened is caused by momentarily opening a contact 13. The relay which opens contact 13 is located within a receiver 12 and is momentarily energized by a transient coded UHF pulse @ $f_1$; electronic circuitry in the receiver 12 decodes the received signal and operates the relay 4. The pulse which causes contact 13 to open is initiated by the wireless transmitter 15 located somewhere between the green that is protected by the warning strobe light, and the tee to the next hole.

The flashing strobe 6 will normally operate for N minutes unless the push-button switch 30 on the wireless transmitter 15 is activated to transmit a signal via an antenna 10. The signal is received at a receiver 17 in sensor 14 via an antenna 11 causing relay contact 13 to open thereby causing relay 4 to be de-energized. The choice of the time, N, depends on the distances between the sensor and the protected area and the topology of the region. Typically, N is about 4.5 minutes. Setting N=7 minutes accounts for accommodating the slowest players and/or possibly a lost ball; N can be specifically set for a given location by an internal switch adjustment. The function of the wireless link between antennas 10 and 11 is to speed up play. Activating the push button 30 on transmitter 15 by an average playing foursome can save 7–4.5= 2.5 minutes and electrical energy. In the worst case, where one of the golfers in this foursome forgets to activate push-button 30, 2.5 minutes is lost; but, where safety is of prime consideration, this is a small penalty to pay.

In some golf course situations, where carts are optional and golfers are permitted to walk, it may be inconvenient to press switch 3 located on one side of the fairway. It is important that the location of the safety device 14, including the warning strobe light 6, be placed out of the line of play and yet be visible from both the tee and the green, as shown in FIGS. 1*a* and 1*b*.

Figure 3:
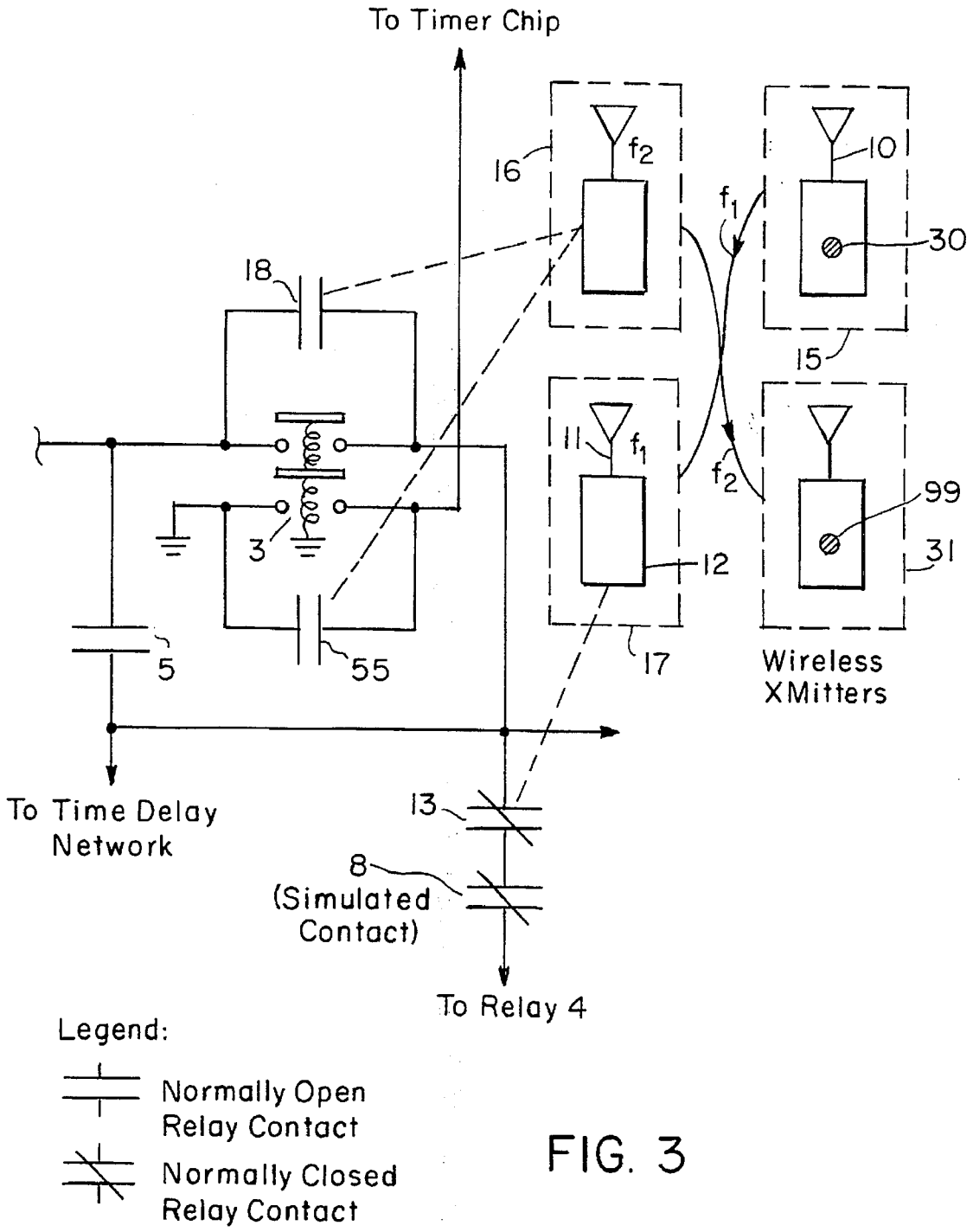

As shown in FIG. 3, one may then wish to install a second wireless link including a transmitter 16 and a receiver 31 operating at a different frequency, $f_2$. This operates a normally open relay contact 18 placed across switch 3, which serves the same function as momentarily closing switch 3. In this case, a second normally open contact 55 is also placed across the second set of poles of switch 3 to properly initiate the timer circuitry 7 as described in Section 3 below.

2. The Strobe Light. A pulsating source of high intensity light 6 is chosen which requires a very low current drain, and can be discerned even in bright sunshine. The current drain associated with the strobe requires 90% of the total battery drain and for this reason must be carefully selected. For this function, a Gentex GXS-4-1575 halogen strobe producing a candela of 75 was chosen and successfully demonstrated over a 6-month period in varying weather conditions in the New England area. Blinking the light at a 1 Hz rate contributes, significantly, to viewing the indicator, especially in periods of bright sunshine. The average current drain for the GXS-4-1575 is about 80 ma. The current drain required by relay 4, time circuit 7, and receiver 15 is about 20 ma. Thus, the total current drain during the N minutes or less the strobe is activated is approximately 0.1 amperes. The receiver 12 for the remote transmitter 15 uses only 5 ma.

Since this type of strobe is not designed to operate continuously, no data on lifetime is available from the manufacturer; these strobes are generally used in fire alarm applications. It has been tested by the inventors in a laboratory where it has operated continuously in excess of 1000 hours.

Figure 4:
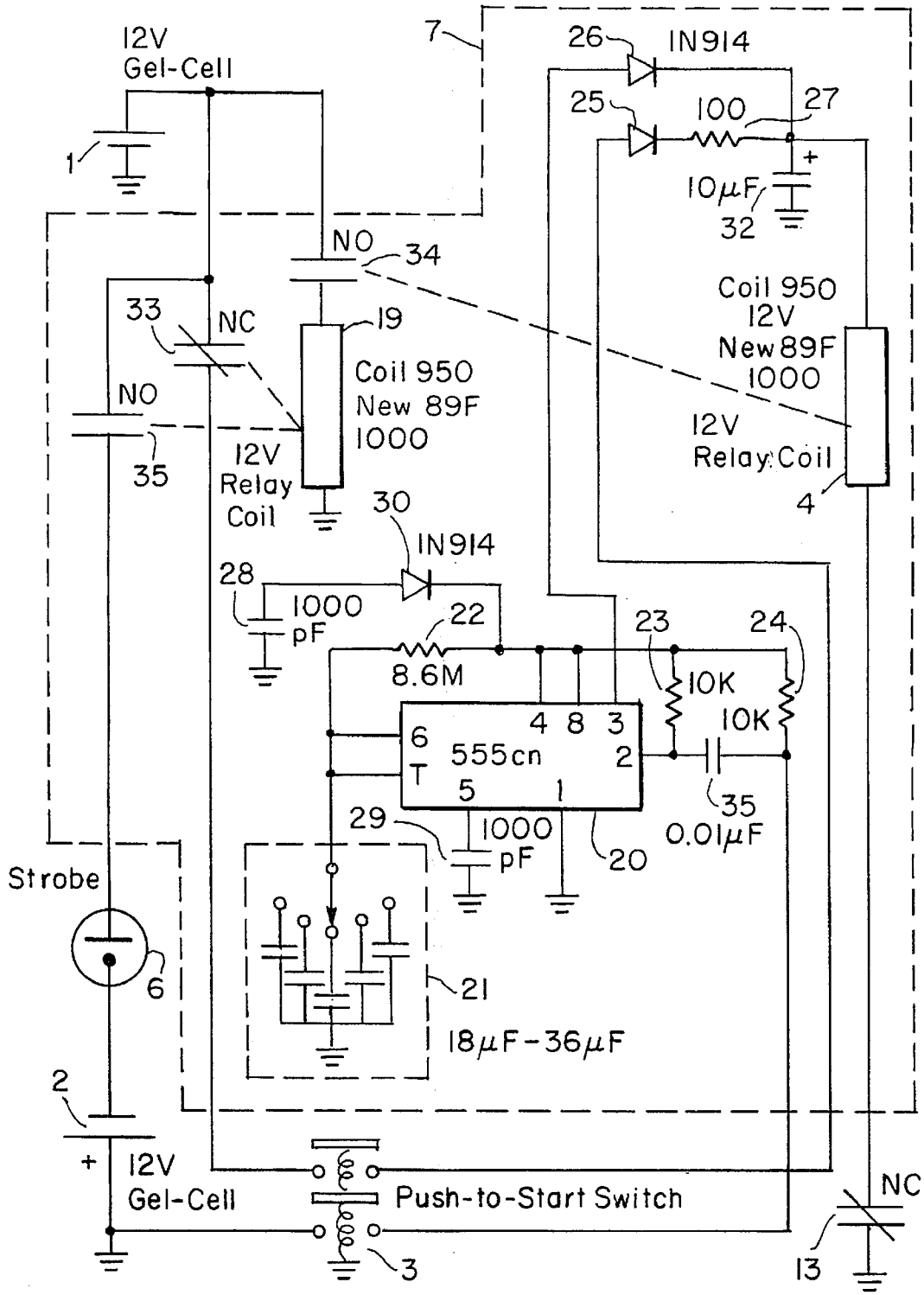

3. The Timing Circuit. The purpose of the timing circuit, as shown in FIG. 4, is to deenergize the strobe 6 and support circuitry after N minutes. In the preferred embodiment of the subject invention, capacitor bank 21, whose values are selected by an internal SP5T switch in conjunction with resistor 22, sets the integration time of one-shot multivibrator 20; a type 555 cn chip is used as the switching chip; resistors 23 and 24 set the operating points of the one-shot formed by chip 20, capacitors 21, and resistor 22. Switch 3 uses a second pole to generate a negative pulse which initiates the timer; capacitors 28 and 29 are used for bypassing transients. When the timer expires, the voltage at terminal #3 on chip 555 cn drops to zero and deenergizes relay 4 which, in turn, opens contact 8, shown in FIG. 2. Diodes 25, 26, and 30 prevent reverse currents caused by switching transients from damaging the timer chip 20. Component 27 is a relay current limiting resistor. Capacitor 32 is used for smoothing to assure relay 4 remains energized when switch 3 opens. In the preferred embodiment of the invention, the reset time can be varied from 3.5 to 7 minutes using the network shown in FIG. 4. Solid state devices can be used to eliminate relays in production units.

The actual operation of the timer circuit 7 shown in FIG. 4 is as follows: (1) press push-to-start button 3; (2) this applies 12 volts through normally closed contact 33 of relay 19 to relay 4; (3) this action closes the normally open contact 34 of relay 4 internal to timer circuit 7, applying 12 volts to relay 19 which causes its contact 35 to apply 24 volts across the strobe light (causing it to flash at a 1 Hz rate) and 12 volts to the 555 cn chip which, in turn, applies 12 volts to relay 4 via terminal #3 on the chip, which acts as the holding contact (shown as "simulated" relay contact 5 in FIG. 2); (4) when the push-to-start button is released, a negative spike, via the discharge of capacitor 35 by the other terminals of switch 3, is applied to terminal #2 on chip 555 cn and begins the timing cycle of the one-shot multivibrator; (5) when the elapsed time expires, terminal #3 on the chip goes low, relay 4 deenergizes, the cycle ends, and all circuit components return to their quiescent conditions.

4. The Gel-Cells. For the preferred embodiment of the invention, two 12-volt, 12 amp-hour gel-cells 1 and 2 are employed. These batteries can be readily recharged overnight, when necessary. When battery voltage drops, it was found that the blink rate of the strobe changes linearly from 1 Hz (fully charged, G1+G2=24 volts) to a rate of once every 3.5 seconds when the voltages drop to 12 volts. The timing network remains reasonably well calibrated (e.g., approximately 10 seconds) until the terminal voltage of gel-cell 1 drops from 12 to within 9 volts. It is, therefore, important that the minimum voltage be maintained greater than 18 volts. A single 12 amp-hour battery discharges to about 9 volts when its full capacity is reached (18 volts for two in series). Some typical assumptions for determining recharge time are as follows: Four golf foursomes per hour play the hole; there are 12 hours of playing hours in each day; the strobe and other circuitry are on for an average of 5 minutes when activated; there is a 50% seasonal duty factor for weather, morning vs. afternoon play, golf course maintenance, two or three players rather than a foursome, etc. Accordingly, the number of days before recharging is necessary using the preferred embodiment of the invention can be calculated as follows:

| | |
|---|---|
| 4 groups/hr. × 5 min./group × 1 hr./60 min. | = ⅓ effective duty cycle |
| In 1 day, 12 hrs./playing day × ⅓ | = 4 hrs. on-time/day |
| A 50% duty factor reduction | = 2 hrs. on-time/day |
| For amp-hrs. required for a single day, 2 hrs. × 0.1 amp | = 0.2 amp-hrs./day |
| For a 12 amp-hr. battery, this yields an unattended usage time of 12/0.2 | = 60 days without need for recharging |

It was found by trial operations of the safety device that recharging the batteries on the first of each month (or about a 30-day recharge time) can be conveniently and regularly scheduled by the ground maintenance crew. The remote transmitter 9-volt battery 9 should last 3 months or longer.

The the use of a central unit having a low power drain with two possible satellite transmitters 15 and 31, which require no expensive trenching of wires for powering or communications between units, is very advantageous. By recharging the batteries just monthly, they should last years—reducing operating costs.

Another alternative is to power the central unit 14 by a solar panel 120 as shown in FIG. 2 in conjunction with the gel-cells 1 and 2. Solar panels are used to recharge the batteries when the sensor is inert. It is estimated that two 162×72 mm solar panels connected across each gel-cell that deliver 35 ma each at 16 volts would be sufficient, given the duty cycle of operation.

5. The Remote Transmitters and Receivers. Referring to FIG. 2 an off-the-shelf Model TX-66 transmitter and a TX-01 motherboard manufactured by Ming Engineering and Products, Inc. were used to provide the primary wireless link between the central control unit 14 and wireless transmitter 15; the receiver 12 powered from gel-cell 1 requires only 5 ma for operation. The transmitter 15 operates in the preferred implementation at 310 MHz. When activated by push button 30, transmitter 15 radiates a coded pulse train via antenna 10 to reduce the probability of a false alarm or false shut-off command. The TX-66 transmitter can transmit 13 such 1 ms duration pulses, each separated by 1.5 ms: a 13-bit code.

The receiver 12 intercepts the coded serial data train transmitted by transmitter 15 via antenna 11, and if each and every bit matches, activates relay contact 13. In the preferred embodiment of the invention, a matching Ming model RE-66 receiver is employed. The receiver 12 consists of a model RE-01 motherboard that contains a voltage regulator and decoder IC and an output relay; the motherboard provides 5 volts for the receiver module and the serial data decoder.

Figure 5:
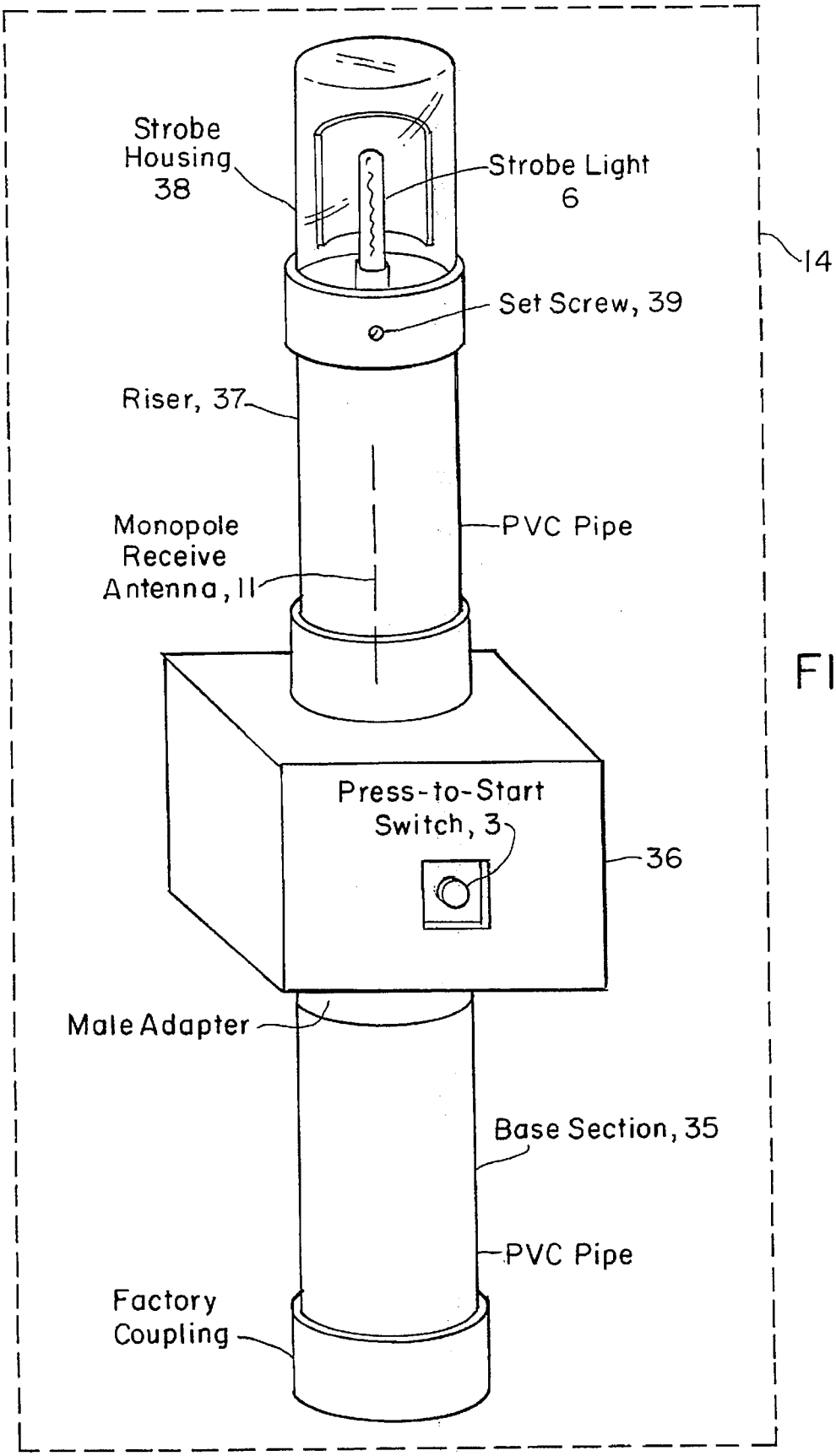

6. Safety Device Housing and Componentry. In the preferred embodiment, the golf safety device consists of four (4) primary sections, as shown in FIG. 5, to allow for varying installation requirements. The device includes a base section 35; a box 36 containing the electronics; a riser 37; and the strobe housing 38.

The base section 35 is typically a 36" long piece of 4" inside diameter (ID) schedule 40 PVC with factory coupling intact. A separate, permanently attached 4" PVC male adapter allows for connection to box 36. The base unit 35 may be used to allow for installation of control wiring from external power, if available. A power cable can be run through the 36" base section 35 to box 36.

Box 36 is a watertight PVC container with a cover which measures approximately 8"×8"×8". It has a drilled top and bottom to accept the 4" PVC male adapters from the base section 35 and the riser section 37. Box 36 provides for the mounting of operating push-to-start button 3 and allows for internal mounting of the electronics and battery storage, 1 and 2. Optional charging unit and remote switching controls may also be mounted in this section.

The riser 37 is a 36" long piece of 4" ID schedule 40 PVC with permanently attached 4" PVC male adapter on the down end connected to the box 36. A permanently attached 4" PVC coupling is provided at the top end to allow for attachment to the strobe housing 38. The riser 37 allows for installation of control wiring from box 36 to light the strobe 6 mounted in the flashing section.

The strobe housing 38, is a 12" long 4.5" outside diameter (OD) cylinder of clear ⅜" acrylic with removable top seal, which is fitted into the coupling at the riser 37 top end and secured by the use of a set screw 39. This section contains the strobe 6, which may be removed for convenient maintenance or replacement. This section may also be rotated to adjust for a preferred installation angle by loosening of the set screw 39. Once adjusted properly for a given location, the set screw 39 is reset.

Base section 35 may be mounted either 2 feet below the earth's surface by digging a 1'×1' hole and then refilling the area with gravel and earth or placed in a 1'×1' hole, 1' deep, containing sakrete and gravel. The type of installation depends on the topology.

Conclusions

The previous section describes a novel golf course safety sensor which requires no external wiring and only battery primary power at the central unit containing the pulsating strobe light. The golf course safety mechanism is activated by a waterproof push-to-start switch located on the central unit or from a remote location via a wireless radio link. The pulsating strobe light is placed in an appropriate location on the course so that it can be seen clearly from the tee and the putting surface even in bright sunlight. A solid state timer is set to deactivate the light and a length of time determined by the slowest golfers; more experienced golfers can save time by recycling the strobe as they leave the protected green by another wireless and battery-operated link. If speedy golfers fail to activate the "feedback" signal to recycle the strobe, safety is preserved, but some time and energy is wasted; this is a small price to pay for avoiding a serious accident.

A system, as described herein, was constructed and successfully demonstrated. The current drain on the main battery(s) was low enough so that the batteries only need be recharged bi-monthly. It was found that monthly recharging fits well into a scheduled golf course maintenance program. The use of solar panels eliminate the recharging task.

The safety device uses all UL approved parts and is designed to comply with Part 15 FCC regulations regarding wireless transmissions. Although the lifetime of the strobe light is not rated by the manufacturer, at least one such strobe unit under continuous operation was found to exceed 1000 hours and is still operating.

It is important to mount the strobe and its reflector in a rotatable assembly so that once the main unit is mounted and the correct orientation is determined (by trial and error) the light source direction can be set by a screw adjustment. The unit can be assembled or disassembled easily for shipping.

Although the description above contains many specificities, these should not be construed as limiting the scope of the invention but as merely providing illustrations of some of the presently preferred embodiments of this invention. Various other embodiments and ramifications are possible within it's scope. It should also be noted that this safety system is not limited to golf courses but is applicable to any environment where one initiating an action can possibly injure one who is temporarily in an area that can be harmed by the results of that action, for example, protecting motorists traveling on a winding road leading to a narrow or unidirectional bridge. Here, the strobe light would be triggered by photoelectric sensors.

Thus, the scope of the invention should be determined by the appended claims and their legal equivalents, rather than by the examples given.

We claim:

1. Safety apparatus for a golf course hole having a tee-off area and a green area hidden from each other by an obstacle for alerting golfers at the tee-off area that golfers on the green who cannot be seen by golfers at the tee-off area are within driver range, said safety apparatus comprising:

means for alerting the golfers at the tee that there are the golfers on the green and not to drive their golf balls off the tee, said alerting means being visible to all of said golfers;

means for activating said alerting means for a predetermined duration after said golfers at the tee-off area have teed off;

means for resetting said alerting means to an initial state from a location at the green at a time less than said predetermined duration after said golfers at the tee-off area have holed out and are leaving the green area thereby increasing the golfer throughout.

2. The safety apparatus of claim 1 wherein said alerting means is a high-intensity, low power drain, pulsating strobe light visible during bright sunlight.

3. The safety apparatus of claim 2 wherein said activating means for said predetermined duration comprises:

a source of power;

a manually operated switch coupled to said power source, a first relay coupled to said power source and said switch for energizing said first relay which closes a normally open relay contact when said switch is operated, said first relay remaining energized through said closed relay contact, wherein said alerting means is coupled to said power source and said relay contact and remains active as long as said relay contact remains closed, an adjustable timer coupled to said power source and responsive to said closed relay contact for opening a timing contact after said predetermined duration, said first relay being deenergized by said opened timing contact thereby causing said relay contact to open to deactivate said alerting means.

4. The safety apparatus of claim 3 wherein said resetting means from said location at said green comprises:

a first wireless remote control unit for transmitting a pulse coded RF signal at a first predetermined frequency when a second manual switch is depressed;

a first receiver responsive to said pulse coded RF signal at said first predetermined frequency for energizing a second relay for opening a normally closed contact for deenergizing said first relay, thereby causing said relay contact to open to resetting said alerting means.

5. The safety apparatus of claim 2 further including activating means from a remote location which comprises:

a second wireless remote control unit for transmitting a pulse coded RF signal at a second predetermined frequency when a third manual switch is depressed;

a second receiver responsive to said pulse coded RF signal at said second predetermined frequency for energizing a third relay for closing a relay contact in parallel with said manually operated switch, thereby activating said timer and said alerting means.

6. Safety apparatus for a golf course hole having a tee-off area and a green area hidden from each other by an obstacle for alerting golfers at the tee-off area that golfers on the green who cannot be seen by golfers at the tee-off area are within driver range, said safety apparatus comprising:

a post located at a location that may be seen from both the tee-off area and the green, said post including, a first manual switch which is momentarily depressed after the golfers have driven their golf balls towards the green, a timing network activated by the momentary depression of said first manual switch for a preset duration, a strobe light mounted on top of said post and activated by the momentary depression of said first manual switch, said timing network maintaining said strobe light in an ON condition for said preset duration, said strobe light being ON for alerting the golfers at the tee that there are the golfers on the green and not to drive their golf balls off the tee;

a second manual switch located near the green which is depressed after the golfers leave the green if said strobe light is still in the ON condition;

a first transmitter activated by a momentary depression of said second manual switch for sending a first frequency signal, said timing network including a first receiver for receiving said first frequency signal for resetting said timing network and placing said strobe light in an OFF condition.

7. The safety apparatus of claim 6 wherein said preset duration is between 3.5 and 7 minutes.

8. The safety apparatus of claim 7 further comprising:

a third manual switch located near the tee which is momentarily depressed after the golfers leave the tee;

a second transmitter activated by a momentary depression of said third manual switch for sending a second frequency signal to reset said timing network and placing said strobe light in an ON condition.

* * * * *